US007188594B2

(12) United States Patent
Yoshizawa

(10) Patent No.: US 7,188,594 B2
(45) Date of Patent: Mar. 13, 2007

(54) APPARATUS AND METHOD FOR CONTROLLING VARIABLE VALVE ACTUATION MECHANISM

(75) Inventor: Hidekazu Yoshizawa, Isesaki (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/349,914

(22) Filed: Feb. 9, 2006

(65) Prior Publication Data

US 2006/0174854 A1 Aug. 10, 2006

(30) Foreign Application Priority Data

Feb. 10, 2005 (JP) ..... 2005-034779

(51) Int. Cl.
*F01L 1/34* (2006.01)
*F02D 11/10* (2006.01)

(52) U.S. Cl. ..... 123/90.15; 123/399; 123/406.23; 123/492

(58) Field of Classification Search ..... 123/90.11, 123/90.15, 345–348, 399, 406.23, 492–493
See application file for complete search history.

(56) References Cited

U.S. PATENT DOCUMENTS 6,920,852 B2 * 7/2005 Machida ..... 123/90.16
7,013,852 B2 * 3/2006 Harada et al. ..... 123/90.15
7,021,258 B2 * 4/2006 Nohara et al. ..... 123/90.16
2005/0193969 A1 * 9/2005 Ezaki et al. ..... 123/90.16
2005/0229883 A1 * 10/2005 Arai et al. ..... 123/90.16
2006/0090728 A1 * 5/2006 Arinaga et al. ..... 123/339.19

FOREIGN PATENT DOCUMENTS

JP 11-82073 3/1999
JP 2000-008894 1/2000

* cited by examiner

*Primary Examiner*—Hai Huynh
(74) *Attorney, Agent, or Firm*—Foley & Lardner LLP

(57) ABSTRACT

In an internal combustion engine equipped with a variable valve actuation mechanism, which varies a lift amount of an intake valve, when the lift amount is forcedly controlled at the minimum to learn a detection result of the lift amount at that time, a throttle opening, an ignition timing, and a fuel injection amount are corrected such that an engine torque is not largely decreased in association with a decrease in lift amount.

21 Claims, 9 Drawing Sheets

APPARATUS AND METHOD FOR CONTROLLING VARIABLE VALVE ACTUATION MECHANISM

BACKGROUND OF THE INVENTION

1. Field of the Invention

The present invention relates to an apparatus for controlling a variable valve actuation mechanism which varies operating characteristics of an engine valve.

2. Description of the Related Art

Japanese Unexamined Patent Publication No. 11-082073 discloses an internal combustion engine provided with means for adjusting a phase difference of a camshaft with respect to a crankshaft, and a variable valve timing control apparatus in which a maximum retard position of the camshaft is learned when a target of an advance position amount is set at zero in the camshaft.

Japanese Unexamined Patent Publication No. 2000-8894 discloses an engine provided with a solenoid-driven valve in which the engine valve is withdrawn and driven by a solenoid coil, and a control apparatus in which an output value of a lift sensor is learned as a value corresponding to a reference position when the engine valve is stopped at a moment of starting of the engine.

As described in the foregoing, in the conventional mechanism for variably actuating an engine valve, i.e., the conventional variable valve actuation mechanism, the learning of the reference position is performed on a condition such that the variable valve actuation mechanism is controlled at a reference position based on a request of an engine operating condition.

Accordingly, a problem is encountered in which the condition of the learning is limited to a particular operating state to thereby hardly ensure a sufficient learning frequency.

At this stage, if the variable valve actuation mechanism is forcedly driven at the reference position, restriction of the learning condition will not occur.

However, if the variable valve actuation mechanism is forcedly driven at the reference position, an amount of intake air by the engine changes due to the change in the operating characteristics of the engine valve. Therefore, an engine torque demanded by a driver becomes different from the actual engine torque.

Accordingly, in the conventional variable valve actuation mechanism, it is practically impossible that the learning is performed while the variable valve actuation mechanism is forcedly driven at the reference position.

SUMMARY OF THE INVENTION

In view of the foregoing, an object of the present invention is to provide an improved control technology for a variable valve actuation mechanism incorporated in an engine, which enables it to prevent an engine operability from being deteriorated in connection with learning of the reference position of the variable valve actuation mechanism and to improve the frequency of learning of the reference position.

In order to achieve the above-mentioned object, the present invention provides a control technology for a variable valve actuation mechanism of an engine which controls the variable valve actuation mechanism to be set at a reference position, and when a result of detection of an operating characteristic of an engine valve is learned during the controlling, engine controlling amounts other than the operating characteristic of the engine valve are controlled according to a demanded engine torque.

The other objects and features of this invention will become understood from the following description with reference to the accompanying drawing.

DESCRIPTION OF THE PREFERRED EMBODIMENT

Figure 1:
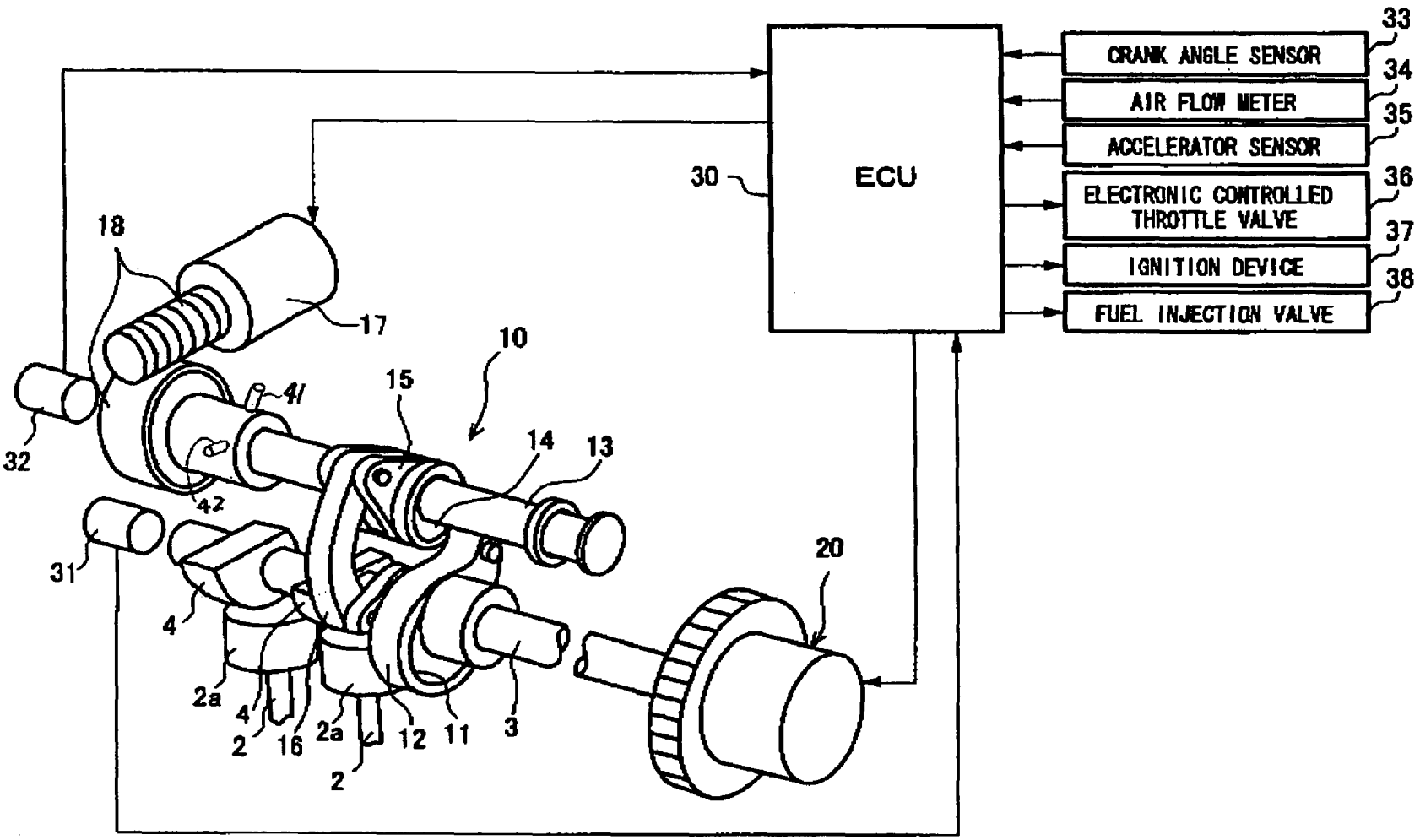
FIG. 1 is a perspective view showing a variable valve actuation mechanism according to an embodiment.

FIG. 1 shows a variable valve actuation mechanism and a control apparatus thereof according to an embodiment of the present invention.

An engine (gasoline internal combustion engine) on which the variable valve actuation mechanism of the embodiment is mounted is provided with a pair of intake valves 2 for each cylinder.

At a portion above intake valves 2, intake drive shaft 3 is rotatably supported to be arranged in a direction in which a row of cylinders is disposed. Intake drive shaft 3 is rotated by a crankshaft (not shown).

Intake drive shaft 3 is fitted thereon with rocking cams 4, which are rotated relatively to drive shaft 3 to be kept in contact with valve lifters 2*a* of intake valves 2, so that respective rocking cams 4 operate to open and close corresponding intake valves 2 via the valve lifters 2*a*.

Variable operating angle control mechanism 10 is provided between intake drive shaft 3 and each of rocking cams 4 to continuously change an angle of operation and an amount of valve lift of each of intake valves 2. At this stage, it should be appreciated that for brevity sake, although only one variable operating angle control mechanism 10 for one of the pair of intake valves 2 is illustrated in FIG. 1, another variable operating angle mechanism 10 is provided for the other of the pair of intake valves 2.

Variable phase-control mechanism 20 is arranged at one end portion of intake drive shaft 3. Variable phase-control mechanism 20 continuously changes a central phase of the operating angle of each intake valve 2 by changing a rotational phase of intake drive shaft 3 relative to the crankshaft.

Figure 2:
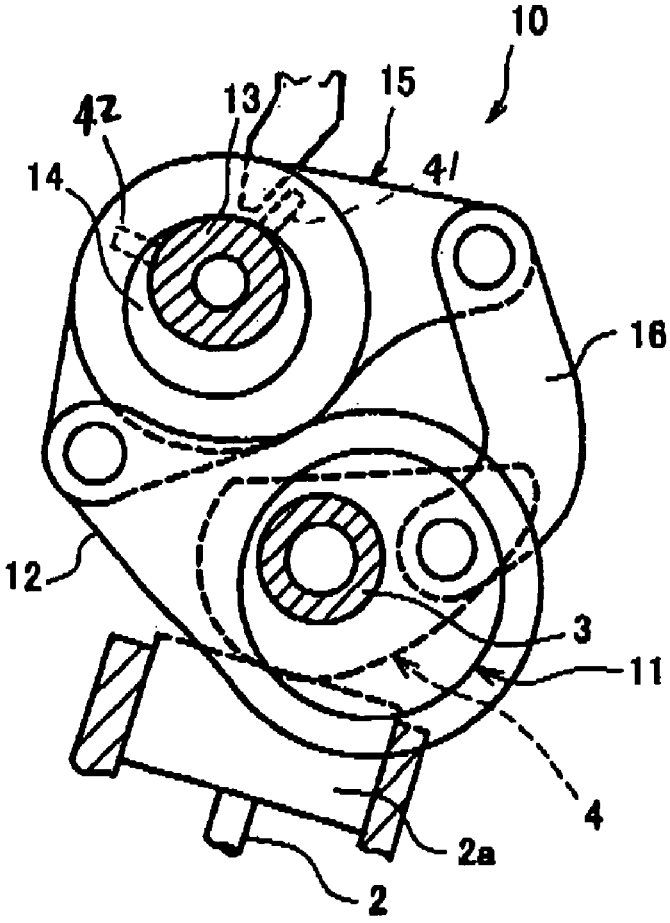
FIG. 2 is a sectional view showing a variable operating angle control mechanism of FIG. 1.

As shown in FIGS. 1 and 2, variable operating angle control mechanism 10 includes circular drive cam 11, ring-shaped link 12, control shaft 13, circular control cam 14, rocker arm 15, and rod-shaped link 16. Drive cam 11 is fixedly mounted on intake drive shaft 3 to be eccentric to intake drive shaft 3. Drive cam 11 is further fitted with ring-shaped link 12 so that ring link 12 can be rotated relatively with respect to drive cam 11. Control shaft 13 extends in the direction of the cylinder row substantially in parallel with intake drive shaft 3. Control cam 14 is fixedly mounted on control shaft 13 to be eccentric to control shaft 13. Control cam 14 is fitted thereon with rocker arm 15 so that rocker arm 15 can be rotated relatively against control cam 14, and one end of rocker arm 15 is coupled to an end of ring-shaped link 12. Rod-shaped link 16 is coupled to the other end of rocker arm 15 and rocking cam 4.

Control shaft 13 is rotated by motor 17 within a predetermined control range through gear train 18.

In the above configuration, when intake drive shaft 3 is rotated in association with the crankshaft, ring-shaped link 12 is driven to do substantially translational motion via drive cam 11 and also, rocker arm 15 is rocked about an axis of control cam 14. This enables rocking cams 4 to be rocked via rod-shape link 16 so as to open and close intake valves 2.

The axis of control cam 14 which is of a rocking center of rocker arm 15 is changed to change an attitude of rocking cams 4 when a rotation angle of control shaft 13 is changed by motor 17. Therefore, the operating angle and the valve lift amount of each intake valve 2 are continuously changed while the central phase of the operating angle of each intake valve 2 is kept substantially constant.

Figure 3:
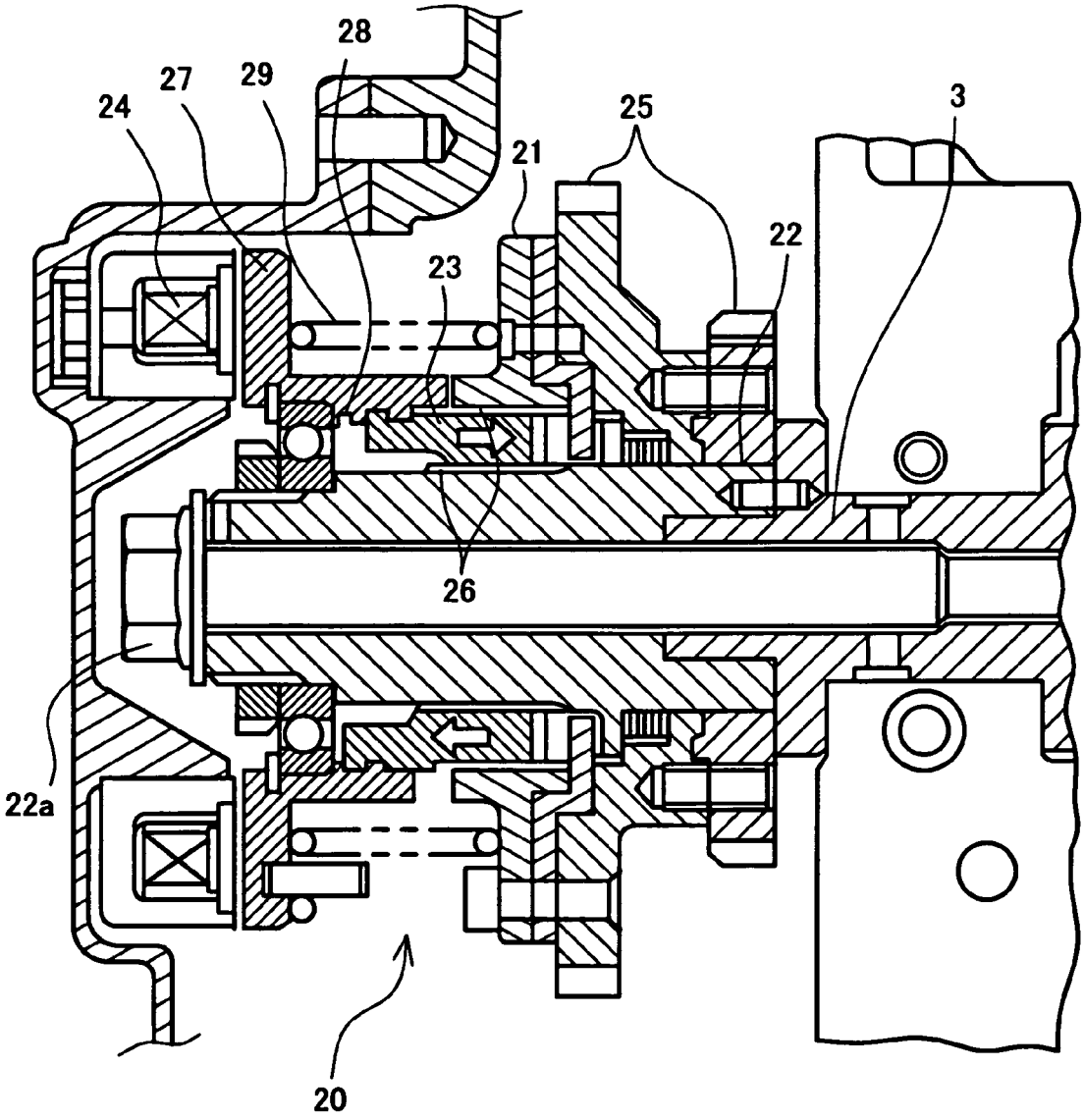
FIG. 3 is a sectional view showing a variable phase-control mechanism of FIG. 1.

FIG. 3 shows variable phase-control mechanism 20.

Variable phase-control mechanism 20 includes first rotation body 21, second rotation body 22, and cylindrical intermediate gear 23. First rotation body 21 is fixed to sprocket 25 which is rotated in synchronization with the crankshaft, and first rotation body 21 is integrally rotated along with sprocket 25. Second rotation body 22 is fixed to one end of intake drive shaft 3 by screw bolts 22*a* , and second rotation body 22 is integrally rotated together with intake drive shaft 3. Intermediate gear 23 engages both an inner peripheral surface of first rotation body 21 and an outer peripheral surface of second rotation body 22 by outer and inner helical splines 26 provided therebetween.

Drum 27 is coupled to intermediate gear 23 through triple threaded screw 28, and torsion spring 29 is inserted between drum 27 and intermediate gear 23 via interposition of rotation body 21.

Intermediate gear 23 is biased in a direction toward a retard angle position (leftward in FIG. 3) by torsion spring 29. When a voltage is applied to electromagnetic retarder 24 to generate a magnetic force, intermediate gear 23 is moved in a direction toward an advance angle position (rightward in FIG. 3) through drum 27 and triple threaded screw 28.

A relative phase between rotation bodies 21 and 22 is changed to change the phase of intake drive shaft 3 with respect to the crankshaft according to a position in an axial direction of intermediate gear 23.

Motor 17 and electromagnetic retarder 24 described above are driven and controlled by control signals from engine control unit (ECU) 30 according to an engine operating state.

Respective detection signals are input from various sensors to engine control unit 30 incorporating therein a microcomputer.

Examples of various sensors can include drive shaft sensor 31, angle sensor 32, crank angle sensor 33, air flow meter 34, and accelerator sensor 35. Drive shaft sensor 31 outputs a detection pulse signal at a predetermined rotational angle position of intake drive shaft 3. Angle sensor 32 which is of a potentiometer continuously detects the rotational angle of control shaft 13. Crank angle sensor 33 outputs a detection pulse signal at each time when the crankshaft is rotated by a predetermined angle (for example, 10 degrees). Air flow meter 34 detects an intake air flow amount of the engine. Accelerator sensor 35 detects a depressing amount of an accelerator pedal (not shown).

Engine control unit 30 operates and controls variable operating angle control mechanism 10 and variable phase-control mechanism 20, which constitute a variable valve actuation mechanism, based on the detection signals from the above-mentioned various sensors. Engine control unit 30 controls opening of electronic-control type throttle valve 36 arranged on the upstream side of intake valves 2, timing of ignition carried out by ignition device 37, and an amount and timing of fuel injection carried out by fuel injection valve 38.

In variable operating angle control mechanism 10, a lift amount and an operating angle of each intake valve 2 can be detected by the rotation angle of control shaft 13, which is detected by angle sensor 32.

Engine control unit 30 performs feedback control of variable operating angle control mechanism 10 in a manner such that the rotational angle of control shaft 13 coincides with a target value requested from the operating state of the engine.

However, a variation in output characteristic of angle sensor 32, unsteadiness in attachment position of angle sensor 32, and the like produce a variation in correlation between the output of angle sensor 32 and the angle of control shaft 13.

When the variation occurs in correlation between the output of angle sensor 32 and the angle of control shaft 13, accuracy in detecting the rotation angle of control shaft 13 based on the output of angle sensor 32 is reduced. As a result, the lift amount and the operating angle of each intake valve 2 cannot be accurately controlled to become their targets.

Therefore, engine control unit 30 learns the output of angle sensor 32 when control shaft 13 is driven at a reference rotation position thereof, and engine control unit 30 corrects the detection characteristic of the rotation angle of control shaft 13, detected based on the output of angle sensor 32, on the basis of the result of learning.

The rotation of control shaft 13 is regulated by each of stoppers 41, 42 provided on a maximum lift side and a minimum lift side of each intake valve 2, and thus engine control unit 30 learns the output of angle sensor 32 in a state where control shaft 13 comes in contact with the stopper 41 on the maximum lift side and also in a state where control shaft 13 comes in contact with the stopper 42 on the minimum lift side, respectively.

Figure 4:
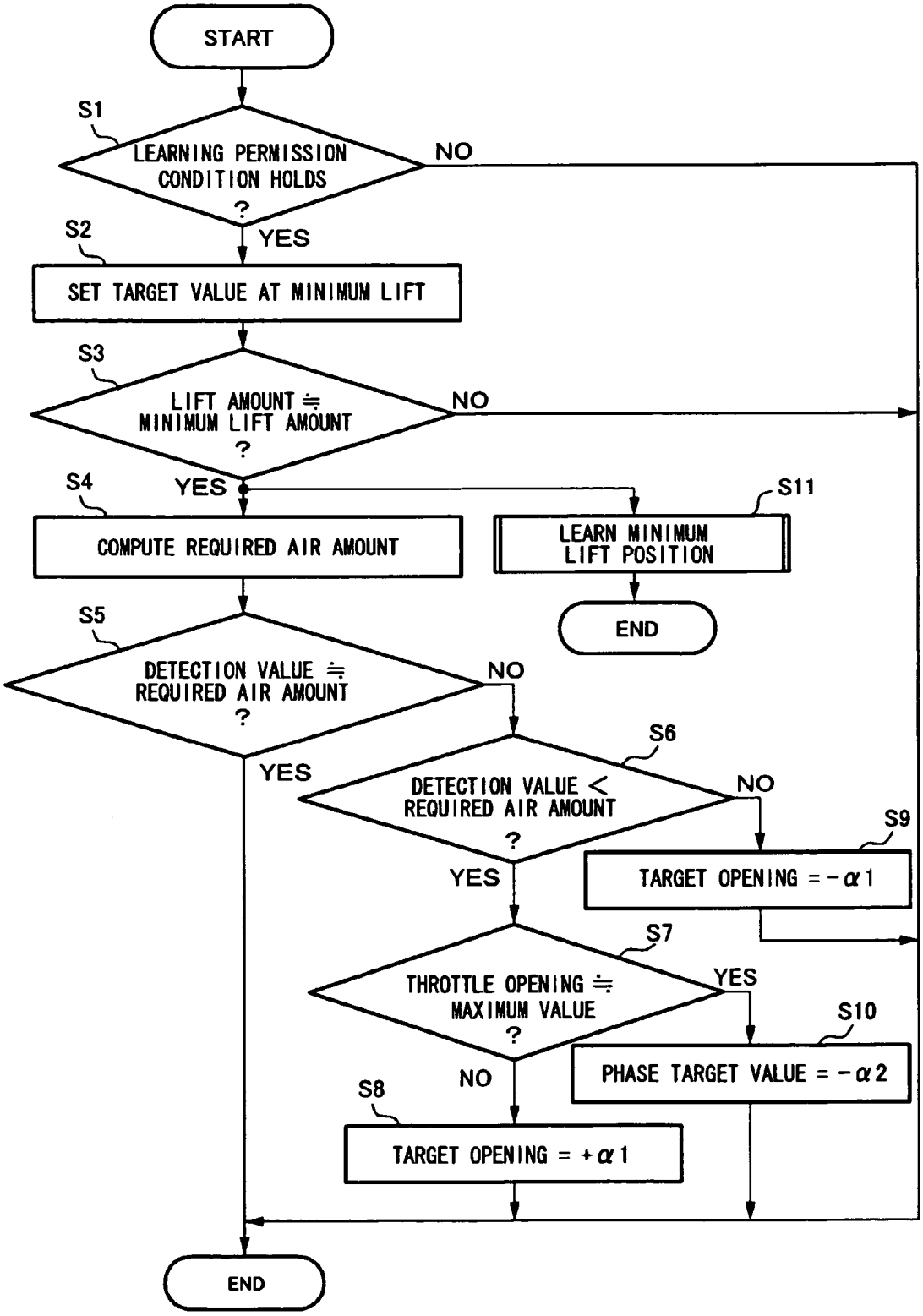
FIG. 4 is a flowchart showing an embodiment in which a minimum lift position is learned while a throttle opening is corrected.

FIG. 4 is a flowchart showing learning control of the minimum lift position.

In Step S1, it is determined whether or not a minimum lift-side learning permission condition holds.

For the minimum lift-side learning permission condition, it is determined whether or not all of the following conditions are established:

(1) engine rotation speed≦predetermined value A1, (2) accelerator opening≦predetermined value B1, (3) a change per unit time in engine rotation speed and accelerator opening is not more than a predetermined amount C, and (4) variable operating angle control mechanism 10, variable phase-control mechanism 20, and electronic controlled throttle valve 36 are at normal operation.

The conditions of (1) and (2) make determination of a low-load and low-rotation-speed operation area where the operation can be performed at the minimum lift. The condition of (3) makes determination of a steady state in which the change in air amount is little.

The condition of (4) is set as a condition for the permission of learning, since the learning and torque correction control for adjusting the torque cannot be performed unless each device is at normal operation.

With the flow chart of FIG. 4, when the minimum lift-side learning permission condition is established, the flow goes from Step S1 to Step S2.

In Step S2, the target value is forcedly set at the minimum lift amount in variable operating angle control mechanism 10, and feedback control is performed.

In Step S3, it is determined whether or not the rotation angle of control shaft 13 detected by angle sensor 32 reaches and exists within a predetermined range where the minimum lift-side learning can be performed.

When the detection result of angle sensor 32 reaches the described range where the learning can be performed, the flow goes to Step S11, and the learning on the minimum lift side is performed.

In the minimum lift-side learning, the state in which control shaft 13 is controlled to the minimum lift amount is continued for a predetermined time to obtain a difference between a previously set sensor output in the minimum lift and the output of angle sensor 32 at that time. A weighted average value of the previous minimum lift-side learning value and the current difference obtained in Step S11 is updated and stored as the new minimum lift-side learning value.

The minimum lift-side learning value indicates the actual correlation with respect to a reference correlation (design value) between the output of angle sensor 32 and control shaft 13 in the form of a variation in sensor output at the minimum lift amount.

Thus, in the minimum lift-side learning, the state in which control shaft 13 is forcedly controlled at the minimum lift amount is continued for the predetermined time. However, when the engine torque is lowered by forcedly decreasing the lift amount, engine operating property must become deteriorated. Therefore, torque control process after Step S4 is performed in parallel with the process of learning in Step S11.

In Step S4, the engine torque demanded by a driver is obtained from accelerator opening, and process to obtain a required amount of air corresponding to the demanded engine torque is conducted.

In Step S5, the intake air amount detected by air flow meter 34 and the request air amount obtained in Step S4 are compared to each other. When the intake air amount is substantially equal to the request air amount, it is determined that a process of correcting the intake air amount is unnecessary, and the routine is ended.

On the other hand, when the deviation not lower than a predetermined value exists between the intake air amount detected by air flow meter 34 and the request air amount obtained in Step S4, the flow goes to Step S6.

In Step S6, it is determined whether or not the intake air amount detected by air flow meter 34 is lower than the request air amount obtained in Step S4.

When the intake air amount detected by air flow meter 34 is lower than the request air amount obtained in Step S4, namely, when the actual torque is lowered with respect to the demanded engine torque, the flow goes to Step S7.

In Step S7, it is determined whether or not the throttle opening is fully opened.

When the throttle opening is not fully opened, the throttle opening is corrected so as to be increased so that a lack of amount of the intake air is cancelled. Therefore, the flow goes to Step S8 where the target opening of electronic-control type throttle valve 36 is increased by a predetermined value $\alpha 1$.

Accordingly, the decrease in intake air amount caused by the forced control of control shaft 13 at the minimum lift amount can be covered to prevent the engine operating property from being deteriorated.

On the other hand, when it is determined that the throttle opening is fully opened in Step S7, the flow goes to Step S10 because the intake air amount cannot be increased by increasing the throttle opening. In Step S10, the correction is performed by decreasing the target value of the advance angle position by a predetermined value $\alpha 2$ in variable phase-control mechanism 20, and closing timing of intake valve 2 is delayed before the intake bottom dead center, which achieves an increase in intake air amount.

In the above description, it is assumed that the intake air amount is decreased by the so-called early closing control before the intake bottom dead center. On the contrary, in the case where the intake air amount of the engine is decreased by delaying the closing timing of intake valve 2 after the intake bottom dead center, the intake air amount can be increased by changing the closing timing of intake valve 2 to the advance position such that the closing timing of intake valve 2 is brought close to the bottom dead center.

In Step S6, when it is determined that the intake air amount detected by air flow meter 34 is not lower than the request air amount obtained in Step S4, the flow goes to Step S9.

In Step S9, the intake air amount which is larger than the demanded torque equivalent is decreased to generate the demanded engine torque by decreasing the target opening of electronic-control type throttle valve 36 by the predetermined value $\alpha 1$.

Thus, in the case where control shaft 13 is forcedly controlled at the minimum lift amount in order to perform the minimum lift position learning, electronic-control type throttle valve 36 and/or variable phase-control mechanism 20 is controlled to ensure the intake air amount corresponding to the demanded engine torque such that the demanded engine torque is obtained even if the intake air amount is changed by the change in lift amount of intake valve 2.

Figure 5:
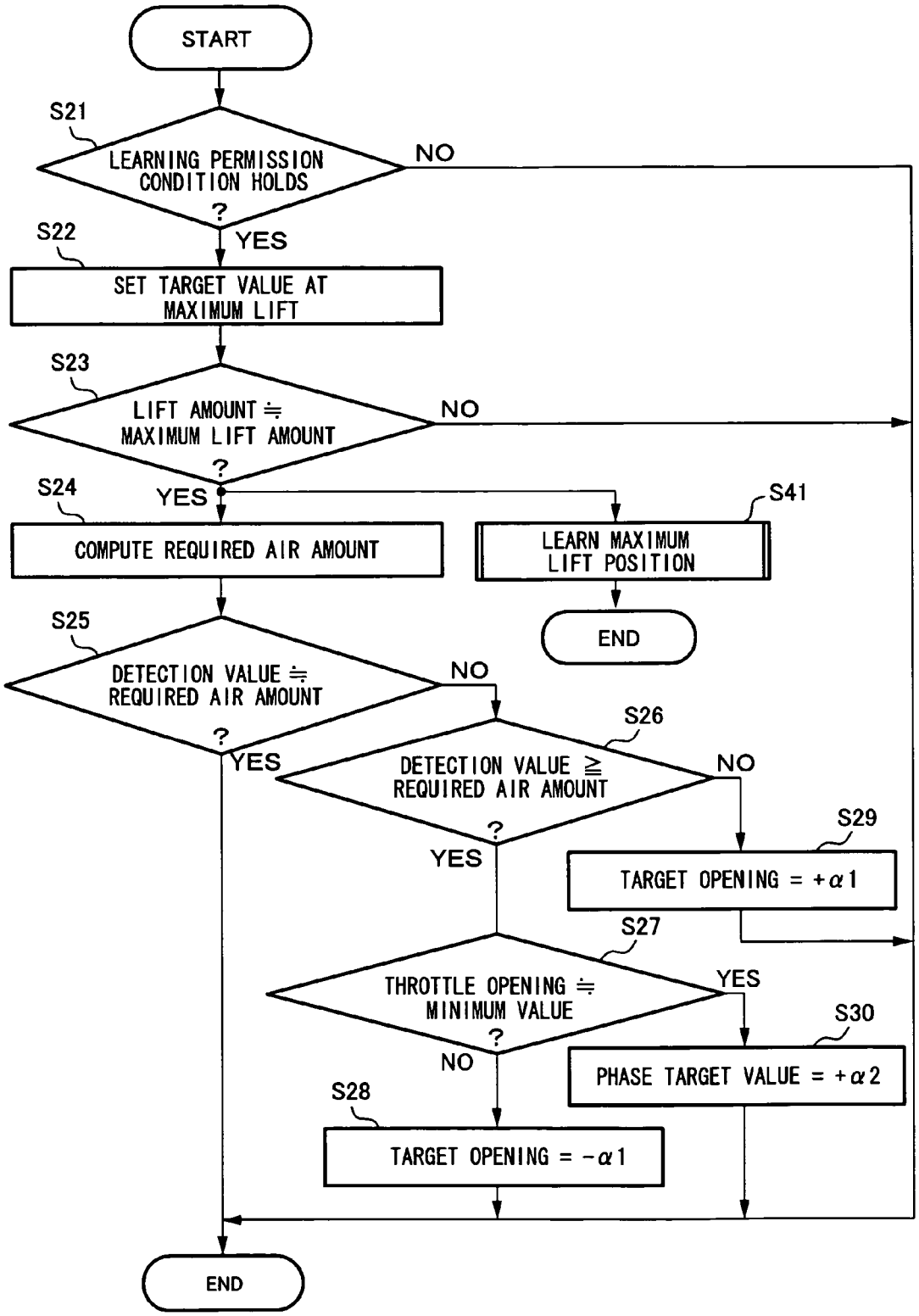
FIG. 5 is a flowchart showing an embodiment in which a maximum lift position is learned while the throttle opening is corrected.

FIG. 5 is a flowchart showing the learning of the maximum lift position. The basic flow of the learning process is similar to the learning of the above-described minimum lift position.

In Step S21, for the maximum lift-side learning permission condition, it is determined whether or not all of the following conditions are established:

(1) engine rotation speed≧predetermined value A2 (>A1), (2) accelerator opening≧predetermined value B2 (>B1), (3) a change per unit time in engine rotation speed and accelerator opening is not more than a predetermined amount C, and (4) variable operating angle control mechanism 10, variable phase-control mechanism 20, and electronic controlled throttle valve 36 are at normal operation.

The conditions of (1) and (2) make a determination of a high-load and high-rotation-speed operation area where the operation can be performed at the maximum lift.

When the maximum lift-side learning permission condition holds, the flow goes to Step S22. In Step S22, the target is set at the maximum lift to perform the feedback control of variable operating angle control mechanism 10.

In Step S23, it is determined whether or not the rotation angle of control shaft 13 detected by angle sensor 32 reaches and exists within a predetermined range where the maximum lift-side learning can be performed.

When the lift amount of intake valve 2 reaches the range where the maximum lift-side learning can be performed, the flow goes to Step S41. In Step S41, the learning of the maximum lift side is performed.

In the maximum lift-side learning, the state in which control shaft 13 is controlled at the maximum lift amount is continued for a predetermined time, and a difference between a previously set sensor output in the maximum lift and the output of angle sensor 32 is obtained at that time. The weighted average value of the previous maximum lift-side learning value and the current deviation determined in Step S41 is updated and stored as the new maximum lift-side learning value.

The maximum lift-side learning value indicates the actual correlation with respect to the reference correlation between the output of angle sensor 32 and control shaft 13 in the form of the variation in sensor output at the maximum lift position.

The actual sensor output characteristic which linearly changes from the actual output at the minimum lift position to the actual output at the maximum lift position can be set by correcting the reference correlation based on the minimum lift-side learning value and the maximum lift-side learning value, and the actual lift amount can be detected with high accuracy even if the variation in sensor exists.

The intake air amount correction control is performed after Step S24 according to the forced control of control shaft 13 at the maximum lift amount.

In Step S24, the required amount of air corresponding to the demanded engine torque is determined.

In Step S25, the intake air amount detected by air flow meter 34 and the request air amount determined in Step S24 are compared to each other. When the intake air amount is substantially equal to the request air amount, it is determined that the process of correcting the intake air amount is unnecessary, and the routine is ended.

On the other hand, when the deviation not lower than a predetermined value exists between the intake air amount detected by air flow meter 34 and the required air amount determined in Step S24, the flow goes to Step S26.

In Step S26, it is determined whether or not the intake air amount detected by air flow meter 34 is not lower than the required air amount obtained in Step S24.

When the intake air amount detected by air flow meter 34 is not lower than the required air amount obtained in Step S24, namely, when the actual torque is increased compared with the demanded engine torque, the flow goes to Step S27.

In Step S27, it is determined or not whether the throttle opening becomes a minimum value.

When the throttle opening is not fully closed, the throttle opening is corrected so as to be decreased, which allows an increase in intake air amount associated with the increase in lift amount to be counterbalanced. Therefore, the flow goes to Step S28, the target opening of electronic-control type throttle valve 36 is decreased by the predetermined value $\alpha 1$.

Accordingly, the increase in intake air amount caused by the forced control of control shaft 13 at the maximum lift amount can be counterbalanced to prevent the operation property from being deteriorated.

On the other hand, when it is determined that the throttle opening is fully closed in Step S27, the flow goes to Step S30 because the intake air amount cannot be decreased by decreasing the throttle opening. In Step S30, the correction is performed by increasing the target value of the advance position by the predetermined value $\alpha 2$ in variable phase-control mechanism 20, and the intake air amount can be decreased by changing the closing timing of intake valve 2 to the advance angle position before the intake bottom dead center.

In Step S26, when it is determined that the intake air amount detected by air flow meter 34 is lower than the required air amount obtained in Step S24, the flow goes to Step S29.

In Step S29, the intake air amount which is smaller than the request torque equivalent is increased to generate the demanded engine torque by increasing the target opening of electronic-control type throttle valve 36 by the predetermined value $\alpha 1$.

Thus, in the case where control shaft 13 is forcedly controlled at the maximum lift amount in order to perform the maximum lift position learning, electronic controlled throttle valve 36 and/or variable phase-control mechanism 20 is controlled to ensure the intake air amount corresponding to the demanded engine torque such that the demanded engine torque is obtained even if the intake air amount is changed by a change in the lift amount of each intake valve 2.

In the above embodiment, in order to learn the minimum lift position and the maximum lift position, the change in engine torque associated with the change in target lift is counterbalanced by the intake air amount correction performed by electronic-control type throttle valve 36 and variable phase-control mechanism 20. The change in engine torque can also be suppressed by correcting the advance position and the retard position of the ignition timing.

Figure 6:
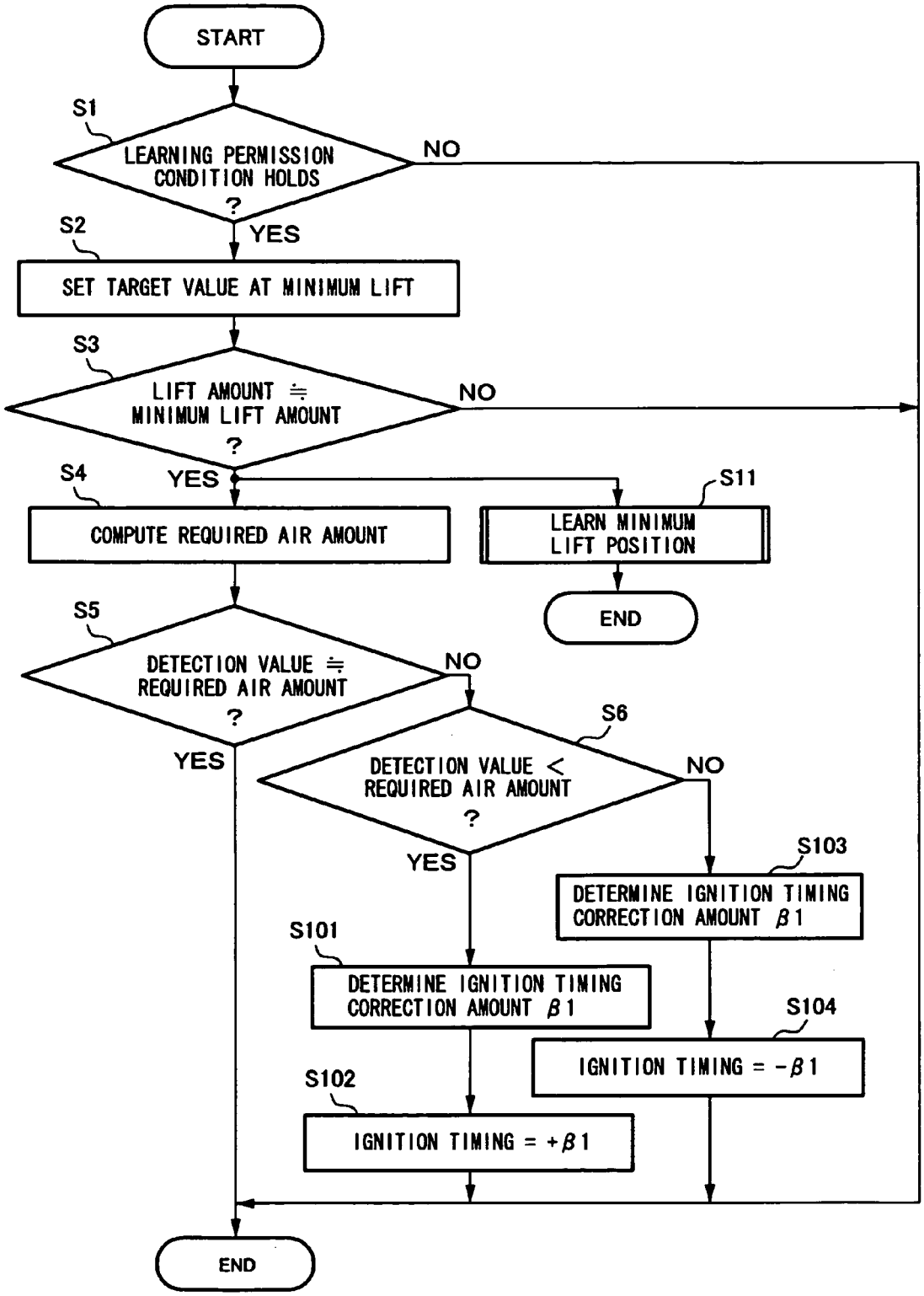
FIG. 6 is a flowchart showing an embodiment in which the minimum lift position is learned while ignition timing is corrected.

FIG. 6 is a flowchart showing an embodiment in which the change in engine torque is suppressed by the correction of the ignition timing while the minimum lift position is learned.

In the flowchart of FIG. 6, the processes in Step S1 to Step S6 and Step S11 are similar to the processes in Step S1 to Step S6 and Step S11 of the flowchart shown in FIG. 4, respectively.

In Step S6, when it is determined that the intake air amount detected by air flow meter 34 is lower than the required air amount obtained in Step S4, the flow goes to Step S101.

In Step S101, an advance angle position correction amount $\beta 1$ of the ignition timing which corrects the engine torque by covering the decrease in intake air amount to increase the engine torque is set from a difference between the intake air amount detected by the air flow meter 34 and the required air amount obtained in Step S4.

In Step S102, the ignition timing is corrected toward the advance angle position by the advance angle position correction amount $\beta 1$, which increases the engine torque.

On the other hand, in Step S6, when it is determined that the intake air amount detected by air flow meter 34 is not lower than the required air amount obtained in Step S4, the flow goes to Step S103.

In Step S103, a retard position correction amount $\beta 1$ of the ignition timing which corrects the engine torque by counterbalancing the increase in intake air amount to decrease the engine torque is set from a difference between the intake air amount detected by the air flow meter 34 and the required air amount obtained in Step S4.

In Step S104, the ignition timing is corrected toward the retard angle position by the retard angle position correction amount β1, which decreases the engine torque.

Figure 7:
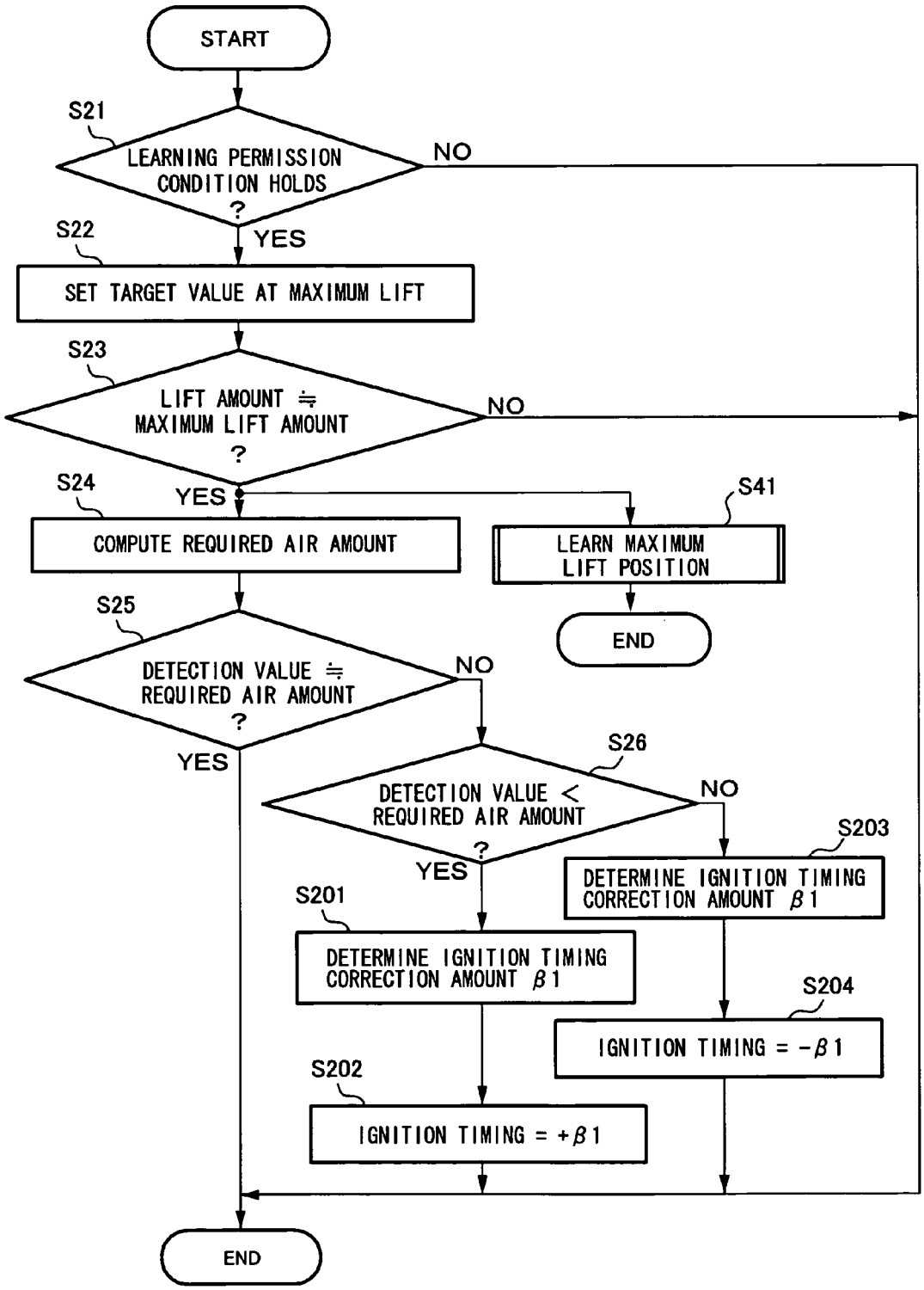
FIG. 7 is a flowchart showing an embodiment in which the maximum lift position is learned while the ignition timing is corrected.

FIG. 7 is a flowchart showing an embodiment in which the change in engine torque is suppressed by the correction of the ignition timing while the maximum lift position is learned.

In the flowchart of FIG. 7, the processes in Step S21 to Step S26 and Step S41 are similar to the processes in Step S21 to Step S26 and Step S41 of the flowchart shown in FIG. 5.

In Step S201 to Step S204, similarly to Step S101 to Step S104 in the flowchart of FIG. 6, the change in engine torque associated with the maximum lift position learning can also be suppressed by correcting the advance position and the retard position of the ignition timing with the correction amount β1 according to the deviation between the intake air amount detected by the air flow meter 34 and the request air amount determined in Step S24.

For the method of suppressing the change in engine torque associated with the minimum lift position learning and the maximum lift position learning, there is a method of increasing and decreasing the engine torque by the rich and lean air fuel ratios, in addition to the above method of correcting the intake air amount with electronic controlled throttle valve 36 and variable phase-control mechanism 20 and the above method of increasing and decreasing the engine torque by the correction of the advance position and the retard position of the ignition timing.

Figure 8:
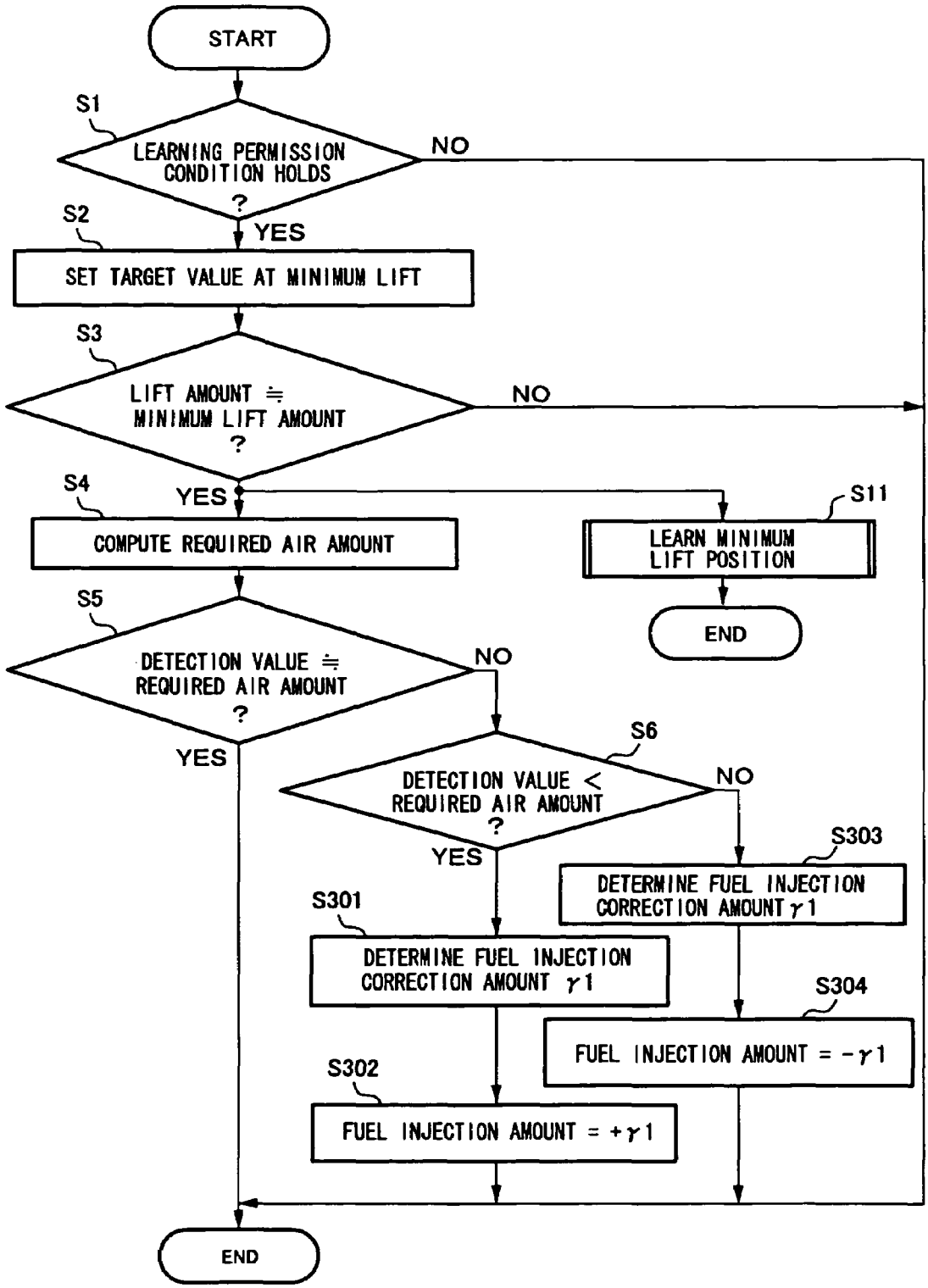
FIG. 8 is a flowchart showing an embodiment in which the minimum lift position is learned while a fuel injection amount is corrected.

FIG. 8 is a flowchart showing an embodiment in which the change in engine torque is suppressed by the correction of the air fuel ratio while the minimum lift position is learned.

In the flowchart of FIG. 8, the processes in Step S1 to Step S6 and Step S11 are similar to the processes in Step S1 to Step S6 and Step S11 of the flowchart shown in FIG. 4.

In Step S6, when it is determined that the intake air amount detected by air flow meter 34 is lower than the required air amount obtained in Step S4, the flow goes to Step S301.

In Step S301, an increase correction amount γ1 of the fuel injection amount which corrects the engine torque by covering the decrease in intake air amount to increase the engine torque is set from a difference between the intake air amount detected by the air flow meter 34 and the required air amount obtained in Step S4.

In Step S302, the fuel injection amount is corrected to increase by the increase correction amount γ1 to rich the air fuel ratio, which increases the engine torque.

On the other hand, in Step S6, when it is determined that the intake air amount detected by air flow meter 34 is not lower than the required air amount obtained in Step S4, the flow goes to Step S303.

In Step S303, a decrease correction amount γ1 of the fuel injection amount which corrects the engine torque by counterbalancing the increase in intake air amount to decrease the engine torque is set from a difference between the intake air amount detected by the air flow meter 34 and the required air amount obtained in Step S4.

In Step S304, the fuel injection amount is corrected to decrease by the decrease correction amount γ1 to lean the air fuel ratio, which decreases the engine torque.

Figure 9:
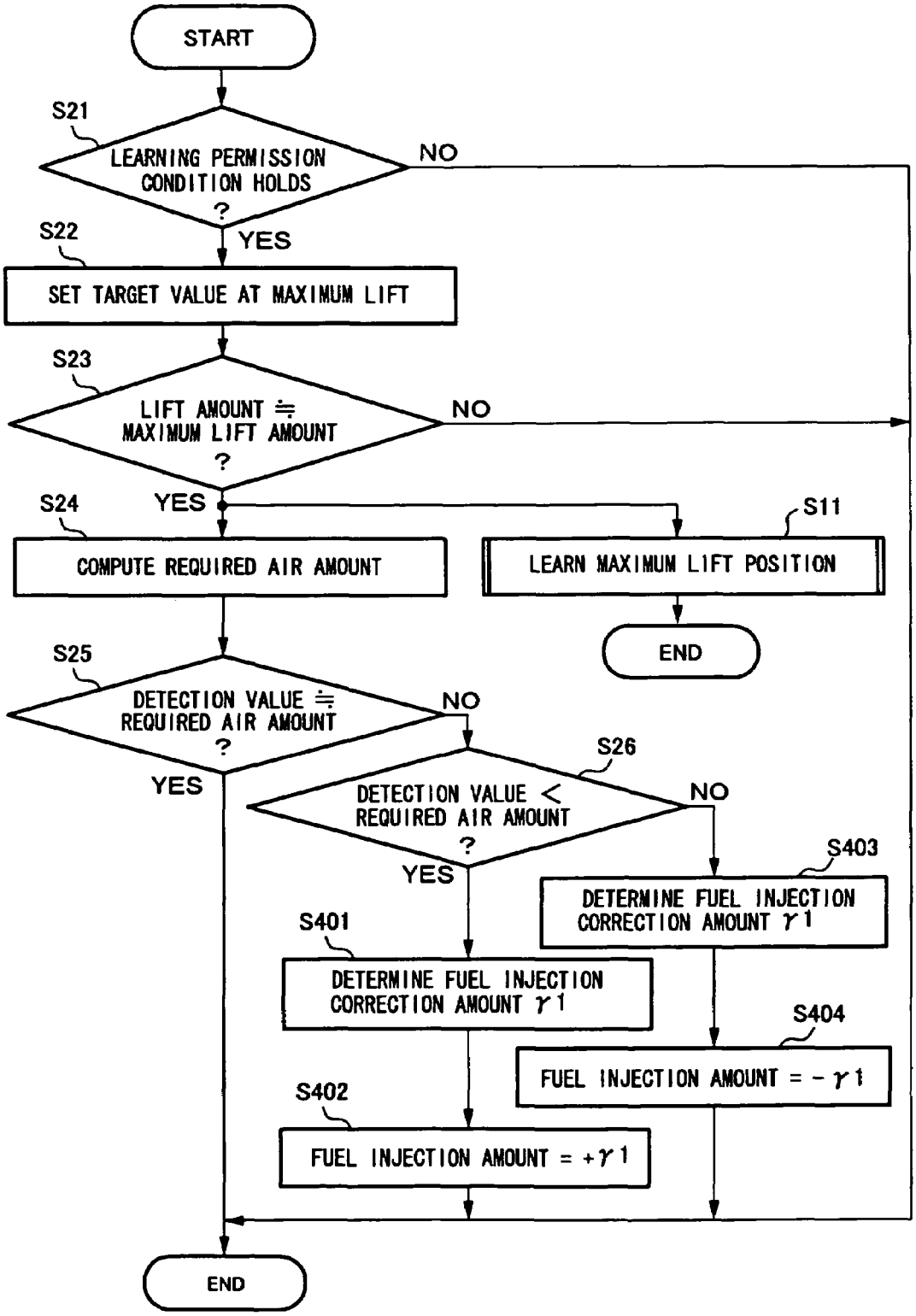
FIG. 9 is a flowchart showing an embodiment in which the maximum lift position is learned while the fuel injection amount is corrected.

FIG. 9 is a flowchart showing an embodiment in which the change in engine torque is suppressed by the correction of the air fuel ratio while the maximum lift position is learned.

In the flowchart of FIG. 9, the processes in Step S21 to Step S26 and Step S41 are similar to the processes in Step S21 to Step S26 and Step S41 of the flowchart shown in FIG. 5.

In Step S401 to Step S404, similarly to Step S301 to Step S304 in the flowchart of FIG. 8, the change in engine torque associated with the maximum lift position learning can also be suppressed by performing the increase correction and the decrease correction of the fuel injection amount with the correction amount γ1 according to a difference between the intake air amount detected by the air flow meter 34 and the required air amount obtained in Step S24.

In the above embodiments, the variable valve actuation mechanism in which the reference position learning is performed is exemplified as angle changing mechanism 10 shown in FIGS. 1 and 2. Alternatively, the reference position learning in variable phase-control mechanism 20 may be performed in association with the suppression control of the variation in engine torque. The variable valve actuation mechanism is not limited to the mechanism shown in FIGS. 1 to 3.

The reference position learning is not limited to the configuration in which the reference position learning is performed at each of the both ends within the control range of the variable valve actuation mechanism. For example, the reference position learning in variable operating angle control mechanism 10 may be performed at either the minimum lift position or the maximum lift position.

The suppression of the variation in engine torque associated with the reference position learning may be performed by combining the intake air amount correction by the electronic-control type throttle valve 36, the timing correction of ignition, which is carried out by the ignition device 37, and the fuel injection amount (air fuel ratio) correction by the fuel injection valve 38.

In the case of the correction control of the ignition timing and the fuel injection amount, it is preferable to set correction limits of the ignition timing and the fuel injection amount.

The entire contents of Japanese Patent Application No. 2005-034779 filed Feb. 10, 2005 are incorporated herein by reference.

While only selected embodiments have been chosen to illustrate the present invention, it will be apparent to those skilled in the art from this disclosure that various change and modification can be made herein without departing from the scope of the invention as defined in the appended claims.

Furthermore, the foregoing description of the preferred embodiments according to the present invention is provided for illustration only, and not for the purpose of limiting the invention as defined by the appended claims and their equivalents.

I claim:

1. An apparatus for controlling a variable valve actuation mechanism capable of continuously varying operating characteristics of an engine valve, the apparatus comprising:

a detector that is configured to output a detection signal according to the operating characteristics of the engine valve continuously varied by the variable valve actuation mechanism;

a learning unit that is configured to learn the detection signal of said detector at a time when the variable valve actuation mechanism is controlled to come to a reference position at which the actuation of the variable valve actuation mechanism is restricted by a stopper;

a valve control unit that is configured to detect the operating characteristics of the engine valve from the detection signal of the detector based on a learning result of the learning unit, to thereby feedback-control the variable valve actuation mechanism; and a torque control unit that controls engine control amounts other than the operating characteristics of said engine valve according to a demanded engine torque, when the learning by said learning unit is performed.

2. The apparatus for controlling a variable valve actuation mechanism according to claim 1, wherein said learning unit forcedly controls said variable valve actuation mechanism to come to said reference position when a learning condition is established.

3. The apparatus for controlling a variable valve actuation mechanism according to claim 2, wherein said variable valve actuation mechanism comprises a mechanism that is capable of varying an amount of lift of said engine valve, and wherein said reference position controlled by said learning unit is a position where said amount of lift of said engine valve is minimized.

4. The apparatus for controlling a variable valve actuation mechanism according to claim 3, wherein said learning unit determines that the learning condition is established, when said engine is at normal operation in a range of low-load and low rotating speed.

5. The apparatus for controlling a variable valve actuation mechanism according to claim 2, wherein said variable valve actuation mechanism comprises a mechanism capable of varying an amount of lift of said engine valve, and wherein said reference position controlled by said learning unit is a position where said amount of lift of said engine valve is maximized.

6. The apparatus for controlling a variable valve actuation mechanism according to claim 5, wherein said learning unit determines that the learning condition is established, when said engine is at normal operation in a range of high-load and high rotating speed.

7. The apparatus for controlling a variable valve actuation mechanism according to claim 1, wherein said variable valve actuation mechanism comprises a mechanism capable of varying operating characteristics of an intake valve, wherein said engine comprises a throttle valve on an upstream side of the intake valve, and wherein said torque control unit controls opening of said throttle valve according to the demanded engine torque.

8. The apparatus for controlling a variable valve actuation mechanism according to claim 1, wherein said variable valve actuation mechanism comprises a mechanism capable of varying operating characteristics of an intake valve, wherein said engine comprises an ignition device that causes combustion of fuel within a combustion chamber, and wherein said torque control unit controls ignition timing by said ignition device according to the demanded engine torque.

9. The apparatus for controlling a variable valve actuation mechanism according to claim 1, wherein said variable valve actuation mechanism comprises a mechanism capable of varying operating characteristics of an intake valve, wherein said engine comprises a fuel injection valve, and wherein said torque control unit controls an amount of fuel injection by said fuel injection valve according to the demanded engine torque.

10. The apparatus for controlling a variable valve actuation mechanism according to claim 1, wherein said variable valve actuation mechanism comprises a mechanism capable of varying an amount of lift of an intake valve, wherein said apparatus further comprises a variable phase-control mechanism that continuously varies a central phase of an operating angle of said intake valve, and wherein said torque control unit controls said variable phase-control mechanism according to the demanded engine torque.

11. An apparatus for controlling a variable valve actuation mechanism that continuously varies operating characteristics of an engine valve the apparatus comprising:

detection means for outputting a detection signal according to the operating characteristics of the engine valve continuously varied by said variable valve actuation mechanism;

learning means for learning the detection signal of said detection means at a time when the variable valve actuation mechanism is controlled to come to a reference position at which the actuation of the variable valve actuation mechanism is restricted by a stopper;

valve control means for detecting the operating characteristics of the engine valve from the detection signal of the detector means based on a learning result of the learning means, to thereby feedback-control the variable valve actuation mechanism; and torque control means for controlling amounts of engine control other than the operating characteristics of said engine valve according to a demanded engine torque, when the learning by said learning means is performed.

12. A method for controlling a variable valve actuation mechanism which continuously varies operating characteristics of an engine valve the method comprising the steps of:

controlling said variable valve actuation mechanism to come to a reference position at which the actuation of the variable valve actuation mechanism is restricted by a stopper;

learning, at the reference position, an output of a sensor that outputs a detection signal according to the operating characteristics of the engine valve;

detecting the operating characteristics of said engine valve from the detection signal of the sensor, based on the result of the learning;

feedback-controlling the variable valve actuation mechanism based on the detected operating characteristics of the engine valve; and controlling engine control amounts other than the operating characteristics of the engine valve according to a demanded engine torque, when said variable valve actuation mechanism is controlled to come to the reference position.

13. The method for controlling a variable valve actuation mechanism according to claim 12, wherein the step of controlling said variable valve actuation mechanism to the reference position comprises the steps of:

determining whether or not a learning condition is established; and controlling forcedly said variable valve actuation mechanism to come to said reference position when said learning condition is established.

14. The method for controlling a variable valve actuation mechanism according to claim 13, wherein said variable valve actuation mechanism comprises a mechanism capable of varying an amount of lift of said engine valve, and wherein the step of controlling forcedly said variable valve actuation mechanism to the reference position comprises a step of controlling said variable valve actuation mechanism to come to a position where said lift amount is minimized.

15. The method for controlling a variable valve actuation mechanism according to claim 14, wherein the step of determining whether or not said learning condition is established comprises a step of determining that the learning condition is established when said engine is at normal operation in a range of low load and low rotating speed.

16. The method for controlling a variable valve actuation mechanism according to claim 13, wherein said variable valve actuation mechanism comprises a mechanism capable of varying an amount of lift of said engine valve, and wherein the step of controlling forcedly said variable valve actuation mechanism to the reference position comprises a step of controlling said variable valve actuation mechanism to come to a position where said lift amount is maximized.

17. The method for controlling a variable valve actuation mechanism according to claim 16, wherein the step of determining whether or not the learning condition is established comprises a step of determining that the learning condition is established when said engine is at normal operation in a range of high load and highrotating speed.

18. The method for controlling a variable valve actuation mechanism according to claim 12, wherein said variable valve actuation mechanism comprises a mechanism capable of varying operating characteristics of an intake valve, and wherein the step of controlling said engine control amount according the demanded engine torque comprises a step of controlling opening of a throttle valve, which is arranged on an upstream side of said intake valve, according to said demanded engine torque.

19. The method for controlling a variable valve actuation mechanism according to claim 12, wherein said variable valve actuation mechanism comprises a mechanism capable of varying operating characteristics of an intake valve, and wherein the step of controlling said engine control amount according the demanded engine torque comprises a step of controlling ignition timing by an ignition device according to said demanded engine torque, said ignition device causing combustion of fuel within a combustion chamber of said engine.

20. The method for controlling a variable valve actuation mechanism according to claim 12, wherein said variable valve actuation mechanism comprises a mechanism capable of varying operating characteristics of an intake valve, and wherein the step of controlling said engine control amount according the demanded engine torque comprises a step of controlling a fuel injection amount of a fuel injection valve of said engine according to said demanded engine torque.

21. The method for controlling a variable valve actuation mechanism according to claim 12, wherein said variable valve actuation mechanism comprises a mechanism capable of varying operating characteristics of an intake valve, and wherein the step of controlling said engine control amount according the demanded engine torque comprises a step of controlling a variable phase-control mechanism that allows a central phase of an operating angle of said intake valve to be continuously varied, according to said demanded engine torque.

* * * * *